US007179099B2

(12) United States Patent
Hsieh

(10) Patent No.: US 7,179,099 B2
(45) Date of Patent: Feb. 20, 2007

(54) MEMORY DEVICE HAVING A HIDING AND SWING PLUG AND METHOD FOR HIDING AND SWING A PLUG THEREOF

(75) Inventor: Min Yuan Hsieh, Taipei (TW)

(73) Assignee: Tul Cooperation, Taipei Hsien (TW)

( * ) Notice: Subject to any disclaimer, the term of this patent is extended or adjusted under 35 U.S.C. 154(b) by 0 days.

(21) Appl. No.: 11/243,432

(22) Filed: Oct. 5, 2005

(65) Prior Publication Data

US 2006/0084284 A1 Apr. 20, 2006

(30) Foreign Application Priority Data

Oct. 15, 2004 (TW) ..... 93131363 A

(51) Int. Cl.
*H01R 13/44* (2006.01)

(52) U.S. Cl. ..... 439/131

(58) Field of Classification Search ..... 439/131, 439/31, 165, 173, 640, 130
See application file for complete search history.

(56) References Cited

U.S. PATENT DOCUMENTS 6,567,273 B1 * 5/2003 Liu et al. ..... 361/737
6,676,419 B1 * 1/2004 Lin et al. ..... 439/76.1
D488,158 S 4/2004 Chen et al.
6,893,267 B1 * 5/2005 Yueh ..... 439/8

FOREIGN PATENT DOCUMENTS

| | | |
|---|---|---|
| TW | 499077 | 8/2002 |
| TW | 531028 | 5/2003 |
| TW | 549493 | 8/2003 |
| TW | 551523 | 9/2003 |
| TW | 555125 | 9/2003 |
| TW | 565041 | 12/2003 |
| TW | 566589 | 12/2003 |

* cited by examiner

*Primary Examiner*—Phuong Dinh
(74) *Attorney, Agent, or Firm*—Rabin & Berdo, P.C.

(57) ABSTRACT

The mean for the universal serial bus hide and swing, its body inside have a sliding unit its head pivot to establish on can swing from as of deal with USB, and a memory to equip the electricity conjunction in deal with USB. The USB can conceal in the body, or along with the sliding unit to swing after being moved the indentation of the body.

17 Claims, 2 Drawing Sheets

MEMORY DEVICE HAVING A HIDING AND SWING PLUG AND METHOD FOR HIDING AND SWING A PLUG THEREOF

BACKGROUND OF THE INVENTION (a) Field of the Invention

This invention is concerned with a memory device having a hiding and swing plug and method thereof, especially with the invention of the USB plug, namely being able to hide inside the body and swing freely when pushed out of the body.

(b) Description of the Prior Art

In general, the term such as memory device is used to describe an electronic memory device using the flash memory as its memory storage device. And is a fairly small virtual hard-drive device in terms of its physical size. Because it is small and easy to carry with, more and more people have begun using such a device. But only by inserting the device into a universal serial bus (USB) receptacle on a PC or a notebook can the virtual hard-drive device function. The USB plugs of these kinds of devices are usually quite fragile, and once damaged they can no longer be connected to the computers via a USB receptacle. Therefore, methods of protecting the USB plug should be designed and developed. At the moment, the only means of protection of the plug itself is to simply cover it by a removable cover, covered when not is use. However, because the small size of the cover, it can be easily lost sometimes.

Furthermore, because of the many different manufacturers of PCs and notebooks, the design, hence the location of the USB port will be different. In addition, because of the many different manufacturers (hence various designs of sizes, shapes, etc.) of the memory sticks, some of the sticks can be thicker than, for example, a notebook, thus requiring the user to adjust the position of the notebook by lifting it up slightly in order to successfully insert the memory stick into the USB receptacle.

Since the usage of USB connected devices such as keyboard, mouse have gradually become more common, most recently designed products of notebooks and PCs will normally have two or more USB ports included, and usually have their layout of the ports adjacent to each other. In other words, when using different shaped, sized memory sticks users sometimes have to squeeze it together with other USB connected devices like a mouse or a keyboard in close vicinity. And due to different sizes of the memory sticks it is sometimes difficult (and occasionally not possible) to insert the stick into the USB port on the computer.

The patents concerning the designs of memory sticks, including such as the USB interface connector described in "Blue-Tooth Device With Dual Rotating Shafts," Taiwan's (TW) utility model patent No. 566,589 filed on Apr. 14, 2002, to a device with dual rotating shafts is connected to an electronic device that is capable of transmitting the blue-tooth data. Another a TW utility model patent No. 555,125 "Portable Data Storage Device," filed on Dec. 31, 2002, which the second power connection portion is connected to the first power connection portion when the battery dock is connected to the USB main body. Further some USB interface connectors described in "Portable Data Storage Device Having A Rotating Connector," TW utility model patent No. 551,523 filed on Jun. 6, 2002; "Assembling Structure Of Portable Memory Device," TW utility model patent No. 549,493 filed on Nov. 9, 2001; "Portable memory storage device," TW utility model patent No. 531,028 filed on Jan. 11, 2002; and a TW utility model patent No. 499,077 "Swiveling Adaptor," filed on Aug. 29, 2001. Chen et al. also described a design of "Universal Serial Bus," in U.S. Pat. No. D488,158 which filed on Apr. 6, 2004.

However, none of these designs, by many designers, engineers of various manufacturers in the industry, has been able to present a satisfactory solution to solving the various problems mentioned in the last three paragraphs above, namely the prevention of damaging the USB plug, lose of the cover, difficulties with connecting a memory stick to a PC or a notebook. So solving the problems above appeared to have some difficulties over the past.

SUMMARY OF THE INVENTION

It is an object of the present invention to provide a new way of thinking and designing a portable memory device that does not need a cover to be put over a USB plug when not in use, and the USB plug (or the body, after connected to a computer) that is able to be swung into different directions. The compatibility of such a portable memory device with various different kinds of PCs or notebooks can therefore be increased.

In order to achieve the above goals, the proposed design of a portable memory device is as followed. The USB plug is designed in a way so it can be hidden and swung. To do that, first, construct a hollow body, and memory chips mounted onto printed circuit board (PCB) is built inside and flash memory included. Then the PCB connects to a USB plug.

The major improvements with regard to this particular case are:

First, building a sliding unit that is able to slide inside the body, and also construct an opening at one end of the body. The sliding unit consisting of a sliding set and a handle, and the sliding unit will be able to slide freely relative to the body. Building a handle on the sliding set and enabling the handle to be accessed through an elongated slot on the upper half of the body. In other words, the movement of the sliding unit can be controlled from the outside of the body by the handle.

The PCB is mounted onto the sliding set or onto the inner side of the body, and a swing-able plug unit is pivoted to the front end of the sliding unit, either way the PCB will be electrically connected to the USB plug. There are few different ways of constructing this swing-able plug unit, however, a more appealing design is to pivot a cover (which has a hole matching the shape and size of the USB plug to allow it to move in and out) onto the end of the body, and having the rotational axes of the cover and the plug lie on the same axis. Moreover, constructing the sliding unit using the bottom half of the body directly can also allow the sliding unit to slide freely and create a relative motion between the body and the sliding unit. Another way is to use only the second half of the body directly to construct the sliding unit.

The elongated slot on the upper half of the body will be constructed to a suitable length that will allow the USB plug to be pushed out through the opening of the body and then be able to swing freely as descry set previously. Also, the space inside the body will be constructed to a suitable size such that it will be longer or at least equal to the total lengths of the set and the USB plug combined, so the USB plug will be able to hide inside the body.

Using the technologies and skills stated above, it is much more feasible way to build such a portable memory device, namely having the PCB fixed to the sliding unit and is then able to slide freely. The movement of the sliding unit can be controlled by the handle which is can be accessed through the elongated slot. The PCB is connected to the sliding unit by the swing-able plug unit. When pushed out of the body, the USB plug can be swung freely.

In regard to this particular case, the USB plug of the portable memory device can move backward or forward in a swinging motion, and does not require another separated cover for protection, yet it will not be damaged while carried around as an ordinary plug without a cover would have been. This particular design should be able to enhance the physical compatibility between a portable memory device and a PC or a notebook. Even if due to specific requirement or design of the shape of the memory device, it is thicker than a notebook, there still will not have the need to adjust the height of the notebook to suit the memory stick. It can also be squeezed together with the plugs from a mouse, a keyboard et cetera, into one small vicinity. Thus, many current problems mentioned above can be solved.

DETAILED DESCRIPTION OF THE PREFERRED EMBODIMENTS

Figure 1:
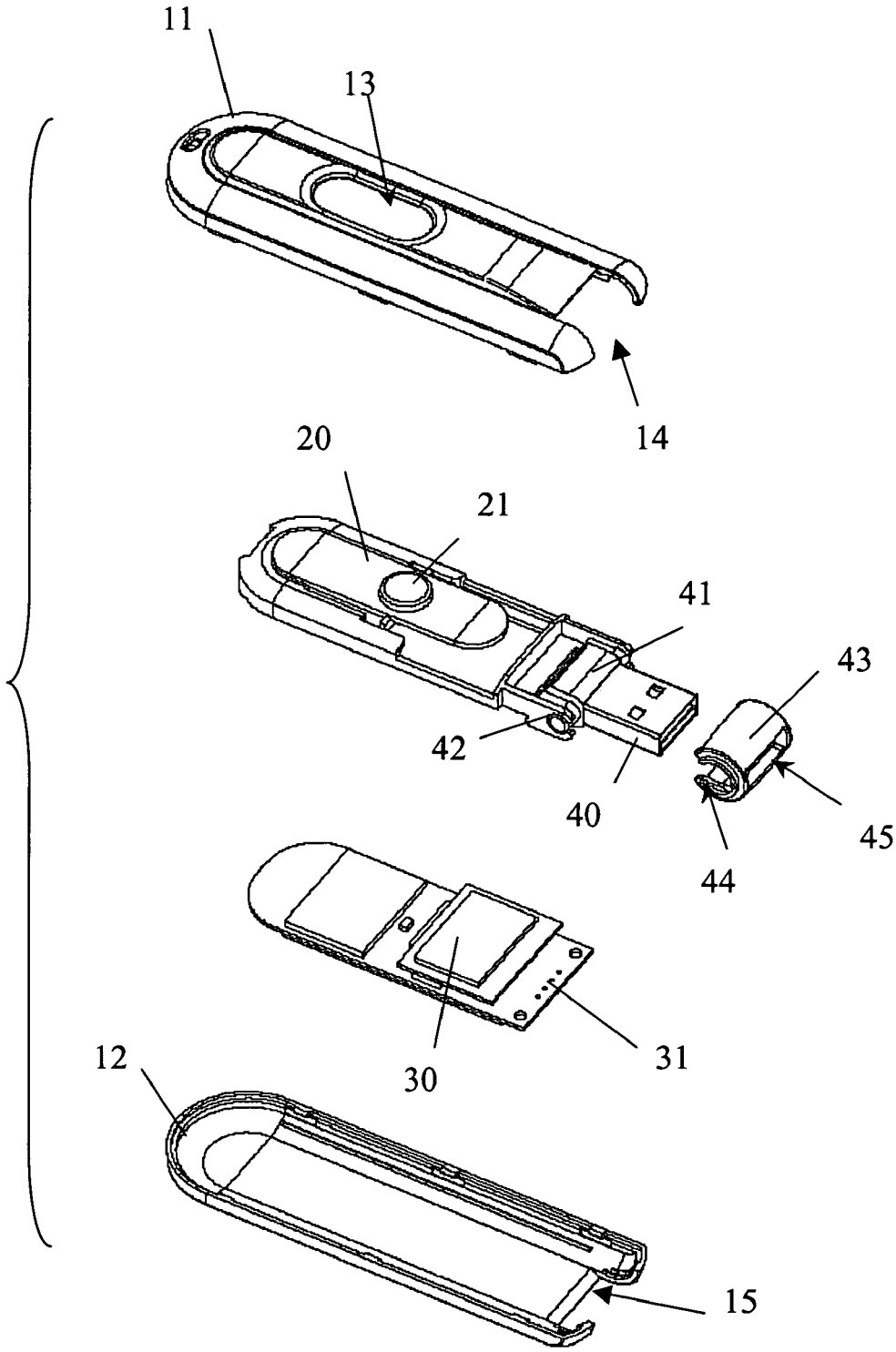
FIG. 1 is an exploded view of a memory device constructed in accordance with the present invention.

According to the design of this particular device, the explanation of its construction with illustrations is as the following.

The main components of the device are (See FIG. 1 and FIG. 2): two halves of lengthened shells, respectively named as upper shell (11) and the bottom shell (12), make up the body (10). Alongside the edges of either the upper shell (11) or the bottom shell (12), a sliding set (20) is installed, and having the elongated slot (13) constructed on the upper shell (11) together to form the sliding unit (See FIG. 2 and FIG. 4 for its schematic drawings). The sliding set (20) has a handle (21), and the elongated slot (13) can be used for the handle (21) to be accessed. The body (10) itself has an opening at one end.

The sliding set (20) is on the inside of the upper shell (11) with the handle (21) pointing upwards and out through the elongated slot (13), hence the movement of the sliding set (20) can be controlled from the top by the handle i.e. outside of the upper shell (11).

The printed circuit board (PCB) (30) accommodated inside the body (10) is fixed onto the sliding set (20). At least one flash memory device is installed as a part of the overall memory device. The USB plug (40) is connected electrically to the PCB (30). FIG. 1 shows how the terminal (31) can be connected through electronic signal communicating wires to the USB plug (40) when constructed underneath the sliding set (20) and therefore the PCB (30) and the sliding set (20) will move simultaneously. Another way of constructing it is to have the PCB (30) fixed onto the bottom half of the body's shell (12), and so it will not move with the motion of the sliding set (20). In this case, longer signal cables will be needed to join the USB plug (40) and the PCB (30) together.

The USB plug (40) is designed to be swing-able and is joined (pivoted) electrically to the PCB (30) by a swing-able plug unit. As shown by FIG. 1, the swing-able plug unit is consisting of a hinge (42) and a swing part (41), the hinge (42) is pivoted at the end of the sliding set (20) while the swing part (41) is connected to the hinge (42) as well, hence the USB plug (40) can swing freely from side to side. This invention herein disclosed has been described by means of specific embodiments; numerous modifications and variations could be made. For example (the figure omitted) the hinge (42) is fixes to the sliding set (20), and the swing part (41) is attaching the USB plug (40). The swing part (41) which interior has the hole pivoted in the hinge (42) to maintenance relative motions each other.

Figure 2:
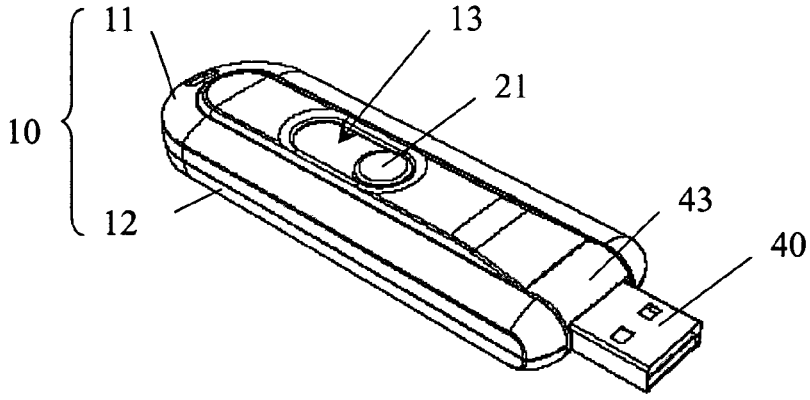
FIG. 2 is a schematic drawing, illustrating the situation when the USB plug is pushed out of the body according to the invention.
Figure 4:
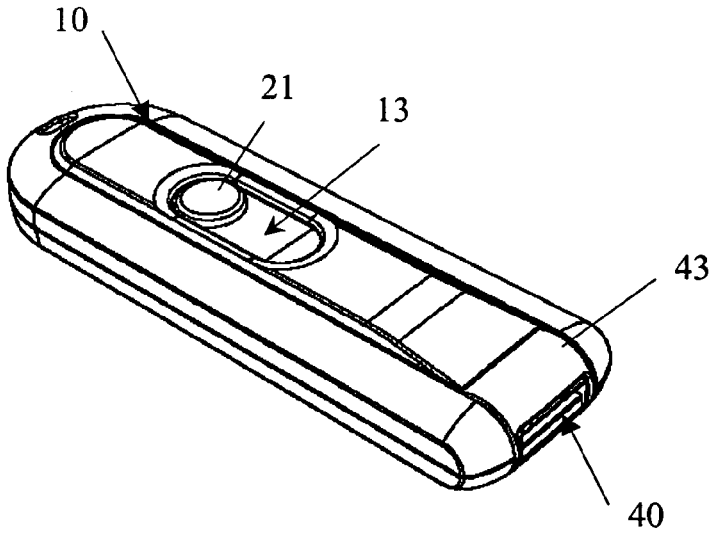
FIG. 4 is similar to the FIG. 2 with the USB plug is hidden inside the body.

As shown by FIG. 1, both the upper shell (11) and the bottom shell (12) have an indentation (14) and (15) respectively. When the two shells are closed, the indentation will form the opening of the body (10). There is another cover (43) having an axial opening (44) on each side, and a hole (45) that is slightly larger than the plug (40), which will allow the USB plug (40) to pass through. The width of this cover (45) is shorter than the width of the indentation (14) of the upper shell and the indentation (15) of the bottom shell, this will just cover the swing part (41) and be pivoted at the opening of the body (10). When the upper and bottom shells (11 and 12) are closed the cover (43) will be locked into position by the opening created by the two indentations (14 and 15) yet able to move in a swinging motion and as shown by FIGS. 2 and 4, the USB plug (40) can move in and out through the hole (45) on the cover (43). Under all circumstances, the PCB (30) and the USB plug (40) will always be connected by signal communicating wires.

No matter how the manufacturer decides to make the handle (21), either as an individual piece which will later be joined together with the sliding set (20) or make the handle (21) and the sliding set (20) as one piece of component, after assembled the sliding set and the handle (20 and 21) will be physically mounted together. And also disregard to whether the manufacturer wants to design the elongated slot (13) on the upper shell (11) or on the bottom shell (12), the idea of using the handle (21) to control the sliding set (20) to be pushed out is the same. Even if the elongated slot (13) is designed on the side of the upper or the bottom shell (11 and 12) in order for the handle to push the sliding set (20) from the side of the body (10), it is still equivalent to the design of this particular memory device. Another possible approach to designing the device is to divide the body (10) up into two pieces (the front and back halves) and have them rather sliding, stretching against each other as a relative motion. For example, when the front half and the back half of the body are pulled away horizontally from each other, the USB plug (40) will be hidden inside, and when the two halves are pushed towards each other, the USB plug (40) will be pushed out from the front half of the body.

In an actual event of using the device, the handle (21) on the outside of the body (10), the sliding set (20) and the USB plug (40) will move simultaneously. In other words, the user can use the handle (21) to push or pull the sliding set (20) and hence move the USB plug (40) in or out of the body (10) through the hole (45) at the front. When the USB plug (40) is pulled back into the body (10) it will be protected by the body (10) itself from colliding, scratching, and other possible external damages. (See FIGS. 2 and 4)

Figure 3:
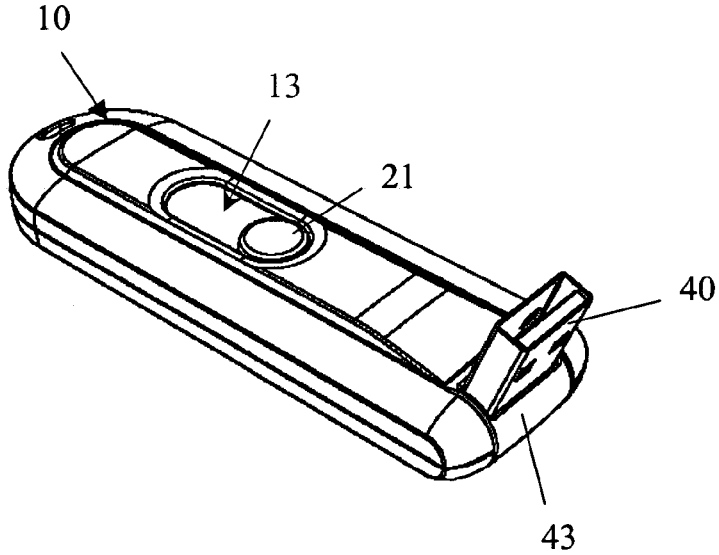
FIG. 3 is similar to the FIG. 2, but demonstrates the movement of the swing-able USB plug.

When the USB plug (40) is pushed out of the body (10) by the sliding set (20), it will then be able to swing either up or down, or from left to right (relative to the user's point of view) (See FIG. 3). If this is the case, even if due to some specific requirement or design of the shape of the memory device, as it could be thicker than a notebook, the user only has to move the USB plug (40) once inserted into the computer in order to avoid adjusting the height of the notebook. The plug of this memory device can also be squeezed adjacent to other computer accessories that may also need to be inserted into a USB receptacle such as a USB mouse, a USB keyboard et cetera. Thus, making it fairly practical and convenient.

The above-mentioned embodiments give evidence of the operability of this invention in details. However, if anyone masters this technology and invents a similar system that has difference either in appearance or in details, will be held legal responsibility of trespassing the originality and patent of this invention. Although certain preferred embodiment of the present invention has been shown and described in detail, it should be understood that various changes and modification might be made therein without departing from the scope of the appended claims.

What is claimed is:

1. A method for hiding and swing a USB plug of a memory device, comprising:

constructing a hollow body and an opening at one end of the body and accommodating a PCB inside of the body; and electrically connecting the PCB to the USB plug; wherein constructing a sliding unit in the body, making the sliding unit possible to slide along the body freely as a relative motion between the body and the sliding unit; and constructing a swing-able plug unit between the sliding unit and the USB plug, allowing the USB plug to move in and out of the opening at the end of the body by using the sliding unit;

pivoting a swing-able cover on the opening of the body; and aligning the swing-able cover and the USB plug on the same pivoting axis.

2. The method according to the claim 1 further comprising:

constructing a hole of the swing-able cover, the hole is larger than the USB plug for allowing the USB plug to be able to move in and out of the hole.

3. The method according to the claim 1 further comprising:

constructing a sliding slot on the body; disposing the sliding unit on the sliding slot; and constructing a handle on the sliding unit for moving the USB plug in and out of the opening.

4. The method according to the claim 3 further comprising: associating the handle and a sliding set to form the sliding unit.

5. The method according to the claim 4 further comprising: constructing the length of the inner space of the body to be longer than or at least equal to the total length of the sliding set connected to the USB plug for enabling the USB plug to hide inside the body.

6. The method according to the claim 4 further comprising: fixing the PCB on the sliding set.

7. The method according to the claim 1 further comprising: fixing the PCB on the body.

8. A memory device comprising a body, a PCB built inside the body, and a plug electrically connected to the PCB; wherein the front end of the body has an opening;

the body accommodates a sliding unit in to move the plug freely;

the plug is pivoted on the front end of the sliding unit; and the sliding unit can move the plug in and out of the opening of the body;

further comprising a swing-able cover with a hole pivoted on one end of the body; wherein the swing-able cover and the plug have the same pivoting axis; and the plug is swing-able freely when the plug is pushed out of the opening.

9. The memory device according to the claim wherein: the hole of the swing-able cover is larger than the plug for allowing the plug to move in and out of the hole.

10. The memory device according to the claim 8 further comprising: a sliding slot acting as a track, the sliding unit disposes a handle exposed on the upper half of the body ; the motion of the sliding unit will be controlled by the handle along the sliding slot.

11. The memory device according to the claim 10, wherein the sliding unit composed of the handle and a sliding set.

12. The memory device according to the claim 8 further comprising: at least one flash-memory disposed onto the PCB.

13. The memory device according to the claim 8, wherein the PCB is mounted onto the sliding unit.

14. The memory device according to the claim 8, wherein the PCB is mounted onto the body.

15. The memory device according to the claim 8, wherein the sliding unit is a second half of the body.

16. The memory device according to the claim 8, wherein the plug is a universal serial bus plug.

17. A memory device comprising a body with an opening at one end, a PCB built inside the body, and a USB plug electrically connected to the PCB; wherein a sliding set is built inside the body, and the sliding set can slide relatively against the body, and the USB plug is pivoted on one end of the sliding set;

further comprising a swing-able cover with a hole pivoted on one end of the body; wherein the swing-able cover and the plug have the same pivoting axis;

the sliding set can push or pull the USB plug out or in through the opening of the body; and when the USB plug is pushed out of the opening, the USB plug is swing-able freely.

* * * * *